US011519422B2

(12) United States Patent
Yuan et al.

(10) Patent No.: US 11,519,422 B2
(45) Date of Patent: Dec. 6, 2022

(54) BLADE AND AXIAL FLOW IMPELLER USING SAME

(71) Applicants: York Guangzhou Air Conditioning and Refrigeration CO., LTD., Qingyuan (CN); Johnson Controls Technology Company, Auburn Hills, MI (US)

(72) Inventors: Bin Yuan, Qingyuan (CN); Shifeng Feng, Qingyuan (CN); Hongdan Wang, Qingyuan (CN); Chenggang Wu, Qingyuan (CN)

(73) Assignees: York Guangzhou Air Conditioning and Refrigeration Co., Ltd., Qingyuan (CN); Johnson Controls Tyco IP Holdings LLP, Milwaukee, WI (US)

( * ) Notice: Subject to any disclaimer, the term of this patent is extended or adjusted under 35 U.S.C. 154(b) by 0 days.

(21) Appl. No.: 17/054,146

(22) PCT Filed: May 8, 2019

(86) PCT No.: PCT/CN2019/085923
§ 371 (c)(1),
(2) Date: Nov. 9, 2020

(87) PCT Pub. No.: WO2019/214632
PCT Pub. Date: Nov. 14, 2019

(65) Prior Publication Data

US 2021/0123454 A1 Apr. 29, 2021

(30) Foreign Application Priority Data

May 9, 2018 (CN) ..... 201810437361.0
May 9, 2018 (CN) ..... 201820688573.1

(51) Int. Cl.
*F04D 29/38* (2006.01)
*F04D 29/66* (2006.01)

(52) U.S. Cl.
CPC ..... *F04D 29/384* (2013.01); *F04D 29/386* (2013.01); *F04D 29/388* (2013.01); *F04D 29/667* (2013.01)

(58) Field of Classification Search
CPC .... F04D 29/384; F04D 29/386; F04D 29/388; F04D 29/667; F01D 5/141
See application file for complete search history.

(56) References Cited

U.S. PATENT DOCUMENTS 2,238,749 A * 4/1941 Peltier ..... F04D 29/384 416/203
6,908,287 B2 * 6/2005 Cho ..... F04D 29/326 415/119

(Continued)

FOREIGN PATENT DOCUMENTS

CN 101725566 A 6/2010
CN 201739227 U 2/2011

(Continued)

OTHER PUBLICATIONS

JP-11294389—Translation from Google (Year: 1999).*

(Continued)

*Primary Examiner* — Richard A Edgar
*Assistant Examiner* — Behnoush Haghighian
(74) *Attorney, Agent, or Firm* — Fletcher Yoder, P.C.

(57) ABSTRACT

A blade (112) includes an upper surface and a lower surface, the upper surface being a pressure face (212), and the lower surface being a suction face (214), a blade tip (216) and a blade base (218), a leading edge (222) and a trailing edge (220), where the pressure face (212) and the suction face (214) each extend from the blade tip (216) to the blade base (Continued)

(218), and each extend from the leading edge (222) to the trailing edge (220). The blade (112) further includes a bent part (262), the bent part (262) being arched from the pressure face (212) toward the suction face (214), where the bent part (262) has a lowest point in a radial cross section of the blade (112), and a connecting line (252) of the lowest points extends in a direction from the leading edge (222) to the trailing edge (220).

11 Claims, 8 Drawing Sheets

(56) References Cited

U.S. PATENT DOCUMENTS

| | | | | |
|---|---|---|---|---|
| 6,991,431 | B2 * | 1/2006 | Ching Wen | F04D 25/088 416/142 |
| 6,994,523 | B2 * | 2/2006 | Eguchi | F04D 29/384 416/228 |
| 8,007,243 | B2 * | 8/2011 | Arinaga | F04D 29/384 416/228 |
| 8,083,487 | B2 * | 12/2011 | Wood | F04D 29/324 416/223 R |
| 8,770,943 | B2 * | 7/2014 | Ishihara | F04D 29/384 416/235 |
| 9,605,686 | B2 * | 3/2017 | Hamada | F04D 29/386 |
| 9,816,521 | B2 * | 11/2017 | Kumon | F04D 29/681 |
| 9,841,032 | B2 * | 12/2017 | Henner | F04D 29/384 |
| 9,970,453 | B2 * | 5/2018 | Henner | F04D 29/384 |
| 10,480,526 | B2 * | 11/2019 | Nakashima | F04D 29/325 |
| 10,487,846 | B2 * | 11/2019 | Kumon | F04D 29/384 |
| 10,697,467 | B2 * | 6/2020 | Froh | F04D 29/388 |
| 10,859,095 | B2 * | 12/2020 | Arai | F04D 29/384 |
| 11,022,139 | B2 * | 6/2021 | Froh | F04D 29/324 |
| 11,067,093 | B2 * | 7/2021 | Tadokoro | F04D 29/384 |
| 2003/0012656 | A1 * | 1/2003 | Cho | F04D 29/326 416/235 |
| 2004/0136830 | A1 * | 7/2004 | Eguchi | F04D 29/667 416/228 |
| 2008/0019826 | A1 * | 1/2008 | Arinaga | F04D 29/384 415/206 |
| 2009/0013532 | A1 * | 1/2009 | Wood | F01D 5/141 29/889.7 |
| 2010/0158677 | A1 * | 6/2010 | Ishihara | F04D 29/384 415/182.1 |
| 2013/0323062 | A1 * | 12/2013 | Henner | F04D 29/384 416/195 |
| 2014/0056710 | A1 * | 2/2014 | Henner | F04D 29/326 416/189 |
| 2015/0044058 | A1 * | 2/2015 | Hamada | F04D 29/386 416/242 |
| 2015/0071786 | A1 * | 3/2015 | Kumon | F04D 29/384 416/223 R |
| 2018/0038384 | A1 * | 2/2018 | Kumon | F04D 29/384 |
| 2018/0238344 | A1 * | 8/2018 | Nakashima | F04D 29/325 |
| 2019/0072104 | A1 * | 3/2019 | Froh | F04D 29/384 |
| 2019/0072105 | A1 * | 3/2019 | Froh | F04D 29/663 |
| 2019/0107118 | A1 * | 4/2019 | Arai | F04D 29/325 |
| 2020/0040906 | A1 * | 2/2020 | Yamamoto | F04D 29/384 |
| 2020/0240429 | A1 * | 7/2020 | Tadokoro | F04D 29/384 |
| 2020/0240430 | A1 * | 7/2020 | Arai | F04D 29/384 |
| 2020/0408225 | A1 * | 12/2020 | Arai | F04D 29/325 |

FOREIGN PATENT DOCUMENTS

| | | | | |
|---|---|---|---|---|
| CN | 202659570 | U | 1/2013 | |
| CN | 105240317 | A | 1/2016 | |
| CN | 108506247 | A | 9/2018 | |
| CN | 208294835 | U | 12/2018 | |
| JP | 11294389 | A * | 10/1999 | F04D 29/384 |
| JP | 2003148395 | A | 5/2003 | |
| JP | 2011179330 | A | 9/2011 | |
| WO | 2015092924 | A1 | 6/2015 | |
| WO | 2016181463 | A1 | 11/2016 | |

OTHER PUBLICATIONS

PCT International Search Report for PCT Application No. PCT/CN2019/085923 dated Jul. 15, 2019, 5 pgs.

European Search Report for EP Application No. 19800854.2, dated Jan. 4, 2022, 7 pgs.

* cited by examiner

BLADE AND AXIAL FLOW IMPELLER USING SAME

TECHNICAL FIELD

The present application relates to the field of rotary machinery such as fans, pumps and compressors, in particular to a blade and an axial flow impeller using same.

BACKGROUND ART

A conventional blade is generally a twisted, smooth streamlined blade; due to serious flow separation at blade surfaces, vortices form, and blade tip leakage is very difficult to avoid, so the blade performance is low and noise is high.

BRIEF SUMMARY OF THE INVENTION

Exemplary embodiments of the present application can solve at least some of the abovementioned problems.

According to a first aspect of the present application, the present application provides a blade, comprising: an upper surface and a lower surface, the upper surface being a pressure face, and the lower surface being a suction face; a blade tip and a blade base; a leading edge and a trailing edge, wherein the pressure face and the suction face each extend from the blade tip to the blade base, and each extend from the leading edge to the trailing edge; and a bent part, the bent part being arched from the pressure face toward the suction face; wherein the bent part has a lowest point in a radial cross section of the blade, and a connecting line of the lowest points extends in a direction from the leading edge to the trailing edge.

In the blade according to the first aspect above, a projection of the blade tip in an axial direction is a first arcuate projection; a projection of the blade base in the axial direction is a second arcuate projection; a projection of the connecting line of the lowest points in the axial direction is a third arcuate projection; the first arcuate projection, the second arcuate projection and the third arcuate projection are concentric.

In the blade according to the first aspect above, a curved line of the bent part along a radial cross section of the blade satisfies:

arch width $w=a\times(\theta/1°)^m$, wherein the value range of a is $0.2\leq a\leq 2$; the value range of m is $1\leq m\leq 3$; θ is a circumferential angle, and the value range of θ is $0°\leq\theta\leq 180°$; arch height $h=b\times(\theta/1°)^n$, wherein the value range of b is $0.05\leq b\leq 1$; the value range of n is $1\leq n\leq 3$; θ is a circumferential angle, and the value range of θ is $0°\leq\theta\leq 180°$.

In the blade according to the first aspect above, m is equal to n, and the value range of w/h is $0.05\leq w/h\leq 0.4$.

According to a second aspect of the present application, the present application provides an axial flow impeller, characterized by comprising: a hub, the hub having a central axis, the hub being able to rotate around the central axis, and a cross section of the hub in an axial direction being circular; and at least two blades, the at least two blades being arranged on an outer circumferential face of the hub, each of the at least two blades comprising: an upper surface and a lower surface, the upper surface being a pressure face, and the lower surface being a suction face; a blade tip and a blade base; a leading edge and a trailing edge, wherein the pressure face and the suction face each extend from the blade tip to the blade base, and each extend from the leading edge to the trailing edge; and a bent part, the bent part being arched from the pressure face toward the suction face; wherein the bent part has a lowest point in a radial cross section of the blade, and a connecting line of the lowest points extends in a direction from the leading edge to the trailing edge.

According to a third aspect of the present application, the present application provides a blade, comprising: an upper surface and a lower surface, the upper surface being a pressure face, and the lower surface being a suction face; a blade tip and a blade base; a leading edge and a trailing edge, wherein the pressure face and the suction face each extend from the blade tip to the blade base, and each extend from the leading edge to the trailing edge; a front part and a rear part, the front part being close to the blade tip, and the rear part being close to the blade base; and a front arched part, the front arched part being located at the front part, and the front arched part being arched from the suction face toward the pressure face; wherein the front arched part has a highest point in a radial cross section of the blade, and a connecting line of the highest points extends in a direction from the leading edge to the trailing edge.

In the blade according to the third aspect above, a projection of the blade tip in an axial direction is a first arcuate projection; a projection of the blade base in the axial direction is a second arcuate projection; a projection of the connecting line of the highest points in the axial direction is a fourth arcuate projection; wherein the first arcuate projection, the second arcuate projection and the fourth arcuate projection are concentric.

In the blade according to the third aspect above, a radial position of the highest point of the front arched part in the radial cross section of the blade gradually deviates from the blade tip toward the blade base in a direction from the leading edge to the trailing edge.

In the blade according to the third aspect above, the projection of the connecting line of the highest points in the axial direction is an involute.

In the blade according to the third aspect above, the ratio of the arch width w of the trailing edge to the length of the trailing edge is greater than or equal to 0.05 and less than or equal to 0.3.

In the blade according to the third aspect above, a curved line of the front arched part along a radial cross section of the blade satisfies:

arch width $w=a\times(\theta/1°)^m$, wherein the value range of a is $0.2\leq a\leq 2$; the value range of m is $1\leq m\leq 3$; θ is a circumferential angle, and the value range of θ is $0°\leq\theta\leq 180°$; arch height $h=b\times(\theta/1°)^n$, wherein the value range of b is $0.05\leq b\leq 1$; the value range of n is $1\leq n\leq 3$; θ is a circumferential angle, and the value range of θ is $0°\leq\theta\leq 180°$.

In the blade according to the third aspect above, m is equal to n, and the value range of w/h is $0.05\leq w/h\leq 0.4$.

In the blade according to the third aspect above, the blade further comprises a bent part, the bent part being arched from the pressure face toward the suction face; wherein the bent part has a lowest point in a radial cross section of the blade, a connecting line of the lowest points extends in a direction from the leading edge to the trailing edge, and the connecting line of the lowest points is in the rear part.

According to a fourth aspect of the present application, the present application provides an axial flow impeller, characterized by comprising: a hub, the hub having an axis, the hub being able to rotate around the axis, and a cross section of the hub in an axial direction being circular; and at least two blades, the at least two blades being arranged on an outer circumferential face of the hub, each of the at least two blades comprising: an upper surface and a lower surface, the upper surface being a pressure face, and the lower surface being a suction face; a blade tip and a blade base; a leading edge and a trailing edge, wherein the pressure face and the suction face each extend from the blade tip to the blade base, and each extend from the leading edge to the trailing edge; a front part and a rear part, the front part being close to the blade tip, and the rear part being close to the blade base; and a front arched part, the front arched part being located at the front part, and the front arched part being arched from the suction face toward the pressure face; wherein the front arched part has a highest point in a radial cross section of the blade, and a connecting line of the highest points extends in a direction from the leading edge to the trailing edge.

The blade of the present application can curb flow separation at blade surfaces, mitigate shedded vortices at the surfaces, and thereby improve the blade performance, and reduce operating noise.

BRIEF DESCRIPTION OF THE DRAWINGS

The features and advantages of the present application can be better understood by reading the following detailed description with reference to the drawings. In all of the drawings, identical reference labels indicate identical components, wherein.

DETAILED DESCRIPTION OF THE INVENTION

Figure 1:
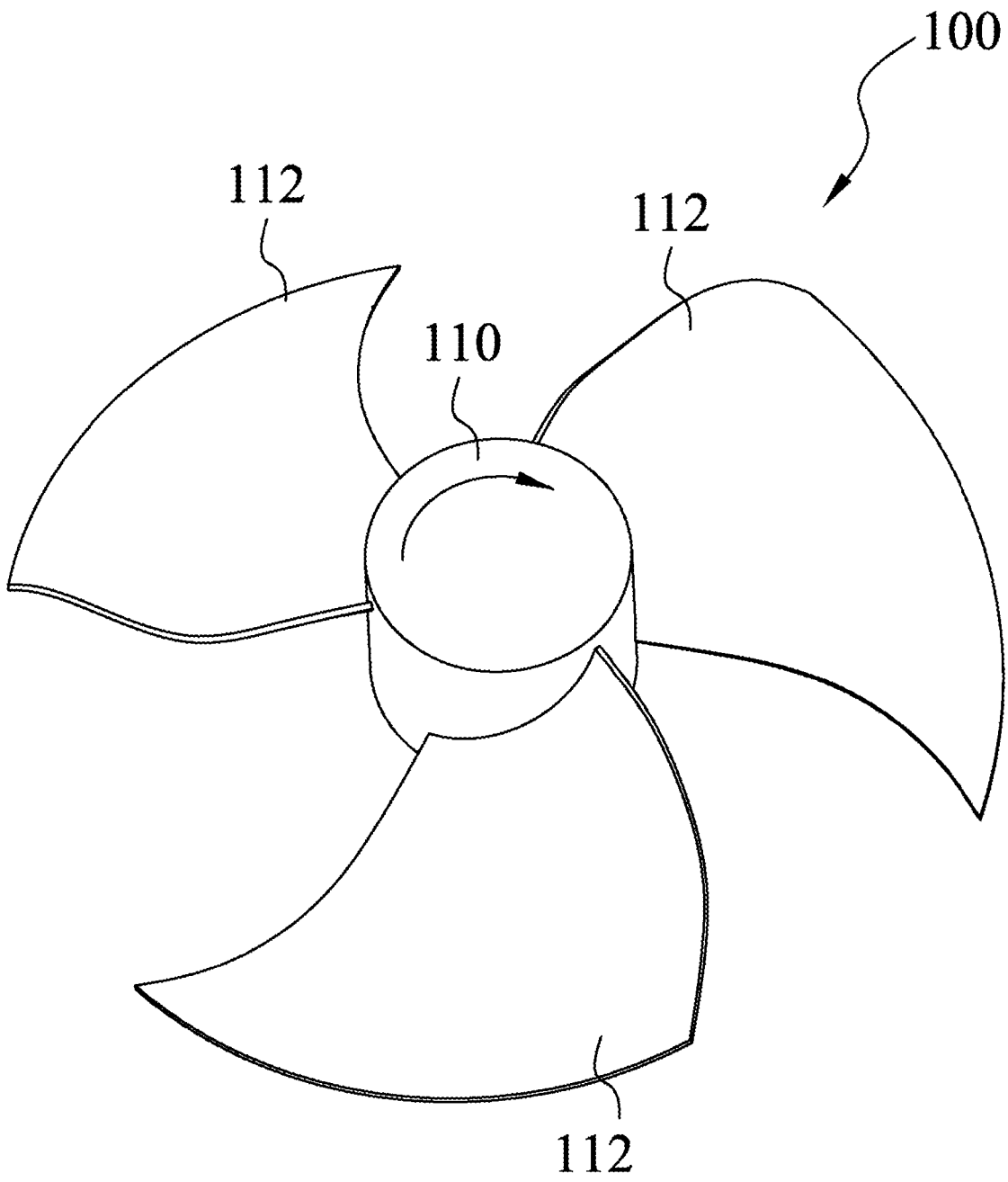
FIG. 1 shows a three-dimensional drawing of an impeller using the blade in an embodiment of the present application.

Various specific embodiments of the present application will be described below with reference to the drawings which form a part of this Specification. It should be understood that terms indicating direction are used in the present application, e.g. "front" meaning close to the blade tip, "rear" meaning close to the blade base, "leading edge" meaning a front-end edge in the rotation direction of the blade, "trailing edge" meaning a rear-end edge in the rotation direction of the blade, "upper" indicating an upper surface (i.e. pressure face) and "lower" indicating a lower surface (i.e. suction face), etc. describe various exemplary structural parts and elements of the present application in a directional or orientational fashion, but these terms are used here solely for the purpose of facilitating explanation, and are determined on the basis of the exemplary orientations shown in the drawings. Since the embodiments disclosed herein may be arranged in different orientations, these terms indicating direction are merely illustrative and should not be regarded as limiting. In the following drawings, the same components use the same reference numbers, and similar components use similar reference numbers so as to avoid repeated descriptions.

FIG. 1 shows a three-dimensional drawing of an impeller 100 using the blade in an embodiment of the present application. As shown in FIG. 1, the impeller 100 comprises a hub 110 and three blades 112. The hub 110 has a central axis, and the hub 110 can rotate around the central axis; a cross section of the hub 110 in an axial direction is circular, and the three blades 112 are uniformly arranged on an outer circumferential face of the hub 110. The hub 110 may be connected to the blades 112 to form a single body. The hub 110 and blades 112 can rotate together around the central axis of the hub 110. As an example, the impeller 100 of the present application rotates in a clockwise direction (i.e. the rotation direction indicated by the arrow in FIG. 1).

Figure 2A:
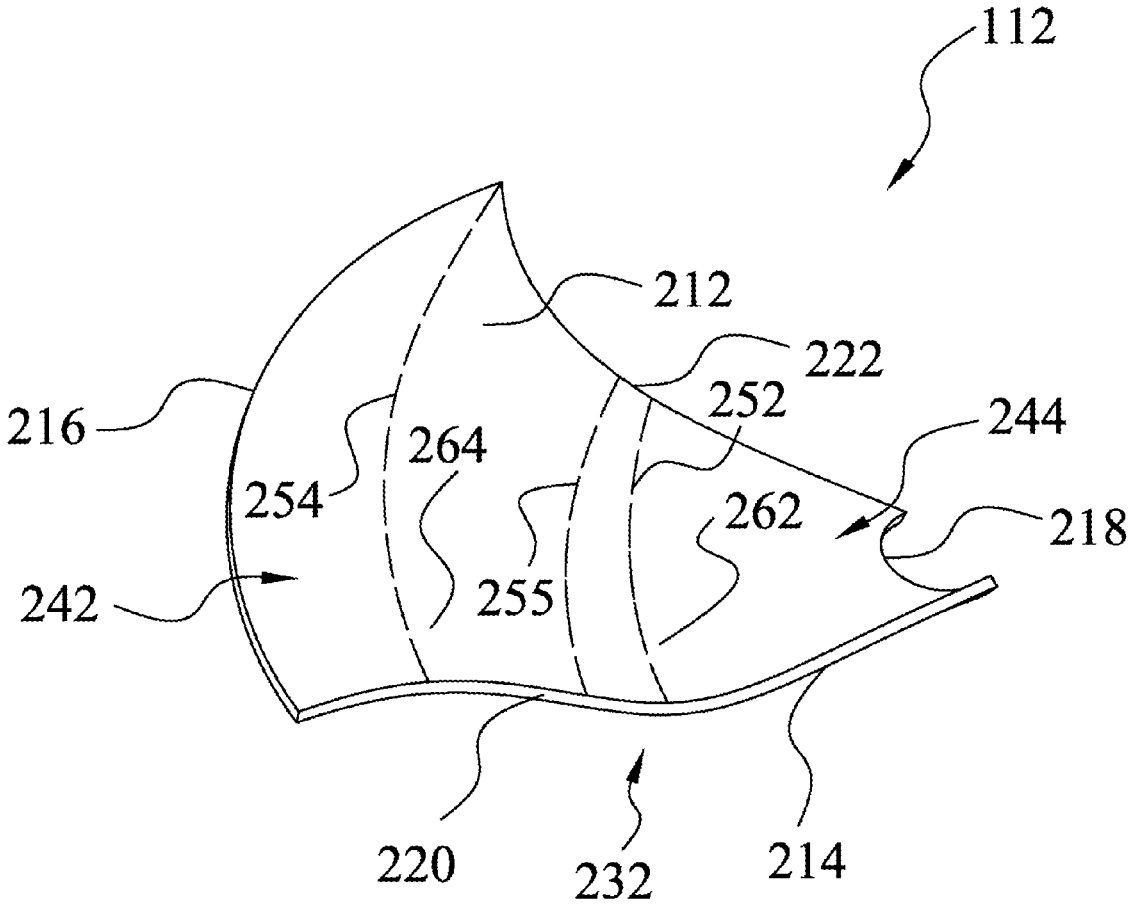
FIG. 2A shows a three-dimensional drawing of the blade used by the impeller in FIG. 1.
Figure 2B:
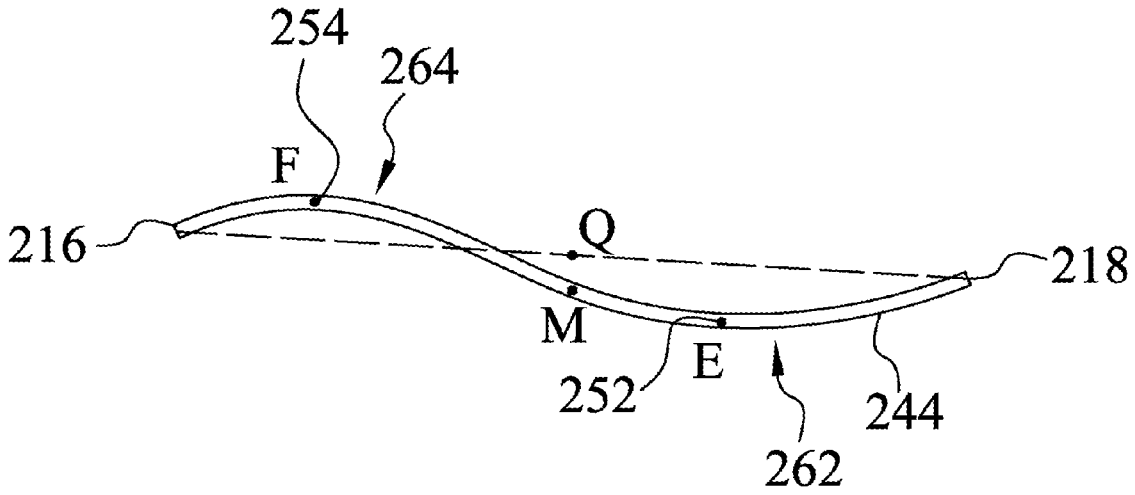
FIG. 2B shows a sectional drawing, in a radial direction, of the blade in FIG. 2A.
Figure 3:
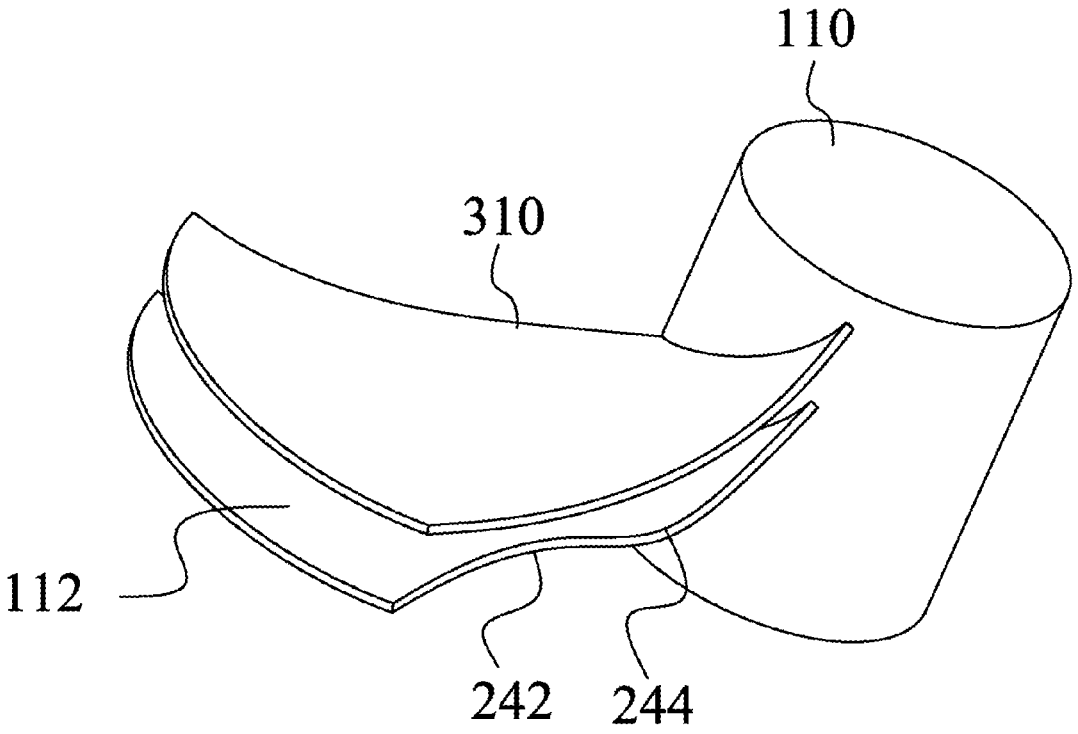
FIG. 3 shows a three-dimensional comparative drawing of the blade in FIG. 2A and a blade in the prior art.
Figure 4:
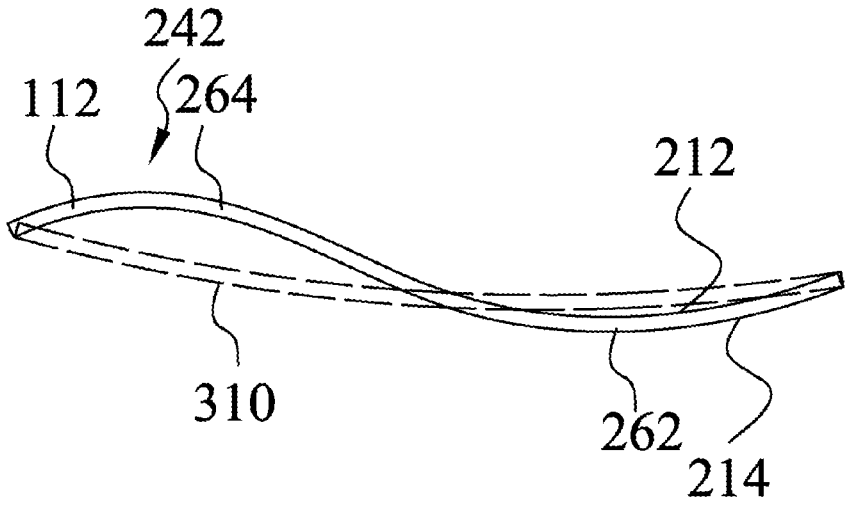
FIG. 4 shows a sectional comparative drawing, in a radial direction, of the blade in FIG. 2A and the blade in the prior art.

FIG. 2A shows a three-dimensional drawing of the blade 112 used by the impeller 100 in FIG. 1; FIG. 2B shows a sectional drawing, in a radial direction, of the blade in FIG. 2A. FIG. 3 shows a three-dimensional comparative drawing of the blade 112 in FIG. 2A and a blade 310 in the prior art; FIG. 4 shows a sectional comparative drawing, in a radial direction, of the blade in FIG. 2A and the blade 310 in the prior art, in order to better show the difference between the blade 112 of the present application and the blade 310 in the prior art. The solid lines in FIG. 2B represent the blade 112 of the present application; the dotted line in FIG. 2B represents a straight connecting line from a blade tip 216 to a blade base 218 in a particular cross section; the solid lines in FIG. 4 represent the blade 112 of the present application; and the dotted lines in FIG. 4 represent the blade 310 in the prior art.

As shown in FIGS. 2A-4, the blade 112 comprises an upper surface, a lower surface, the blade tip 216, the blade base 218, a leading edge 222 and a trailing edge 220. The upper surface is a pressure face 212, and the lower surface is a suction face 214. The blade tip 216 is the position of maximum blade diameter on the blade 112; the blade base 218 is the position on the blade 112 that is configured for connection to the hub 110. The pressure face 212 and suction face 214 each extend from the blade tip 216 to the blade base 218. The leading edge 222 is that side of the blade 112 which faces in the direction of rotation. In other words, when the blade 112 rotates around the central axis of the hub 110, the leading edge 222 is that side of the blade 112 which moves into a fluid. The trailing edge 220 is another side, opposite the leading edge 222, in the blade 112. The pressure face 212 and suction face 214 each extend from the leading edge 222 to the trailing edge 220. The blade 112 comprises a central dividing line 255; the central dividing line 255 is shown as a central dividing point M in a radial cross section of the blade 112. A perpendicular projection point of the central dividing point M onto the straight connecting line of the blade tip 216 and blade base 218 in the radial cross section is a center point Q of the straight connecting line. The blade 112 further comprises a front part 242 and a rear part 244. The front part 242 is a region of the blade 112 from the blade tip 216 to the central dividing line 255 (i.e. a region close to the blade tip 216); the rear part 244 is a region of the blade 112 from the central dividing line 255 to the blade base 218 (i.e. a region close to the blade base 218).

The blade 112 of the present application further comprises a bent part 262. The bent part 262 is arched from the pressure face 212 toward the suction face 214. As shown in FIG. 2B, in a radial cross section of the blade 112, the bent part 262 of the blade 112 has a lowest point E. A connecting line 252 (shown for example in FIG. 2A) connecting the lowest points in radial cross sections of the bent part 262 extends in a direction from the leading edge 222 to the trailing edge 220. Referring to FIG. 4, unlike the blade 310 in the prior art, the bent part 262 of the blade 112 of the present application forms a protrusion at the suction face 214 in a direction from the leading edge 222 to the trailing edge 220, destroying shedded vortices in a radial direction. The protrusion can cause large-volume, high-strength shedded vortices located at the suction face 214 to split into small-volume, low-strength vortices, thereby reducing turbulent dissipation loss. In addition, the bent part 262 forms a recess at the pressure face 212 of the blade 112, so that a portion of fluid leaking from the pressure face 212 to the suction face 214 is guided into the recess. Thus, the bent part 262 can reduce turbulent dissipation loss and leakage loss, in order to reduce noise while improving gas flow and improving the fan's aerodynamic performance.

Continuing to refer to FIGS. 2A-4, the blade 112 further comprises a front arched part 264. The front arched part 264 is located at the front part 242 of the blade 112. The front arched part 264 is arched from the suction face 214 toward the pressure face 212. As shown in FIG. 2B, in a radial cross section of the blade 112, the front arched part 264 of the blade 112 has a highest point F. A connecting line 254 (as shown in FIG. 2A) connecting the highest points F in the radial cross sections extends in a direction from the leading edge 222 to the trailing edge 220. Unlike the blade 310 in the prior art, the front arched part 264 of the blade 112 of the present application forms a recess at the suction face 214 of the blade 112 in a direction from the leading edge 222 to the trailing edge 220. The recess can destroy a leakage mainstream fluid path, such that a leakage stream of the front part 242 is sucked into the recess, curbing the continued development of leakage flow. In addition, at the same time as reducing blade load close to the front part 242, the recess actively transfers load, thereby achieving the effects of improving aerodynamic performance and increasing fan efficiency. Furthermore, the front arched part 264 forms a protrusion at the pressure face 212 of the blade 112 in a direction from the leading edge 222 to the trailing edge 220. The protrusion can delay the position of occurrence of shedded vortices that are shed gradually from the leading edge 222 to the trailing edge 220, and split large-volume, high-strength vortices into small-volume, low-strength vortices, thereby reducing the turbulence strength of the shedded vortices, and reducing noise.

It must be explained that, although the blade 112 comprises the bent part 262 and the front arched part 264 in the embodiment shown in FIGS. 2A-4, according to the principles of the present application, the blade 112 of the present application may also only comprise one of the bent part 262 and the front arched part 264. In addition, it must be explained that although the bent part 262 and the front arched part 264 both extend from the leading edge 222 all the way to the trailing edge 220 in the embodiment shown in FIGS. 2A-4, according to the present application, the bent part 262 and the front arched part 264 may also extend only over a partial region from the leading edge 222 to the trailing edge 220, such that some radial cross sections of the blade 112 do not have the bent part 262 and the front arched part 264. For example, the bent part 262 or the front arched part 264 may begin to extend from the leading edge 222 but end before reaching the trailing edge 220. In addition, the front arched part 264 is located at the front part 242 of the blade 112, and the bent part 262 may be located in any position on the blade 112. That is to say, the bent part 262 may be located at the front part 242 of the blade 112, at the rear part 244 of the blade 112, or at the front part 242 and rear part 244 of the blade 112. All of the above configurations of the blade 112 can reduce noise while increasing fan efficiency.

Figure 5:
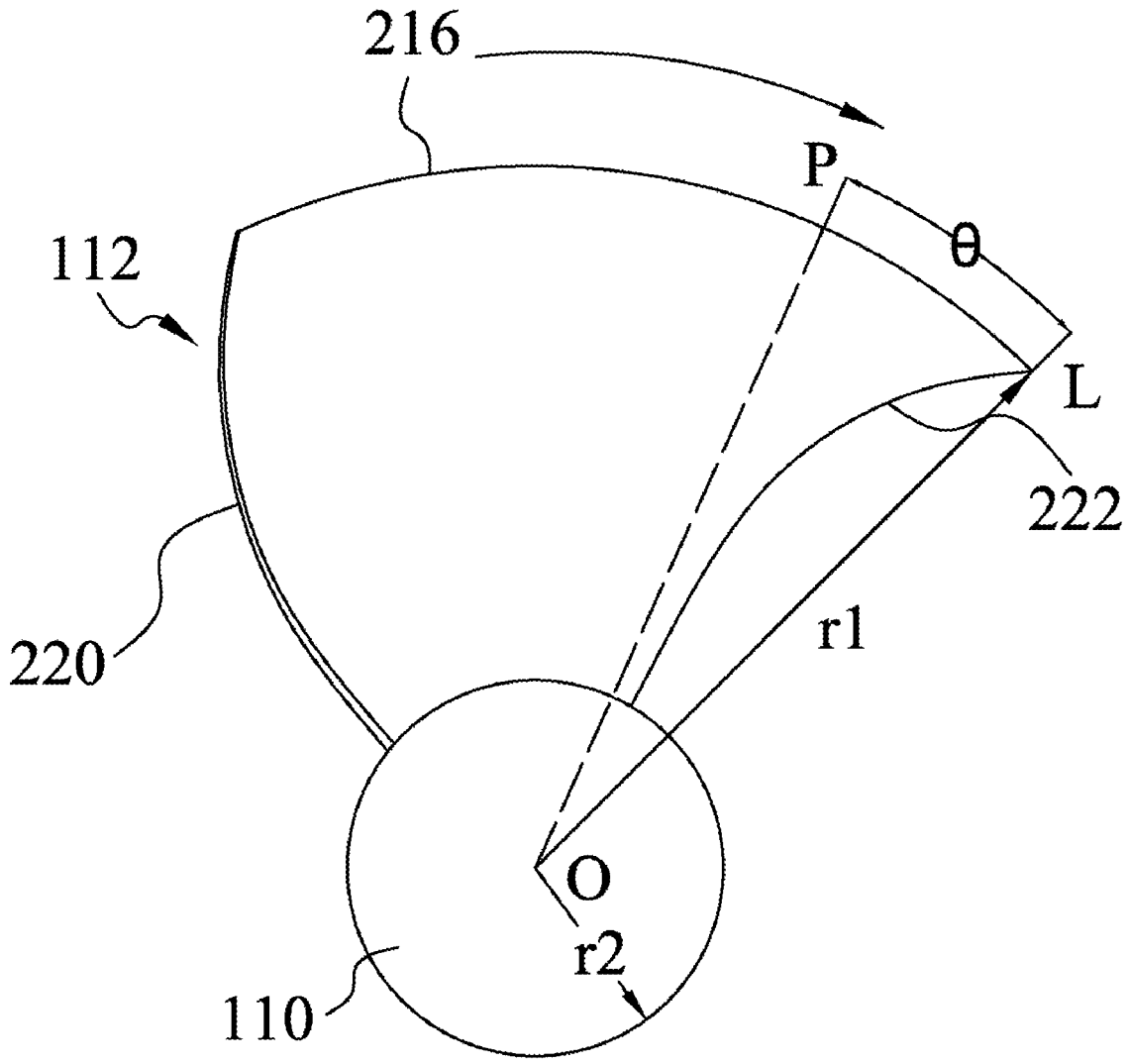
FIG. 5 shows a projection drawing, in an axial direction, of the blade used by the impeller in FIG. 1.
Figure 6:
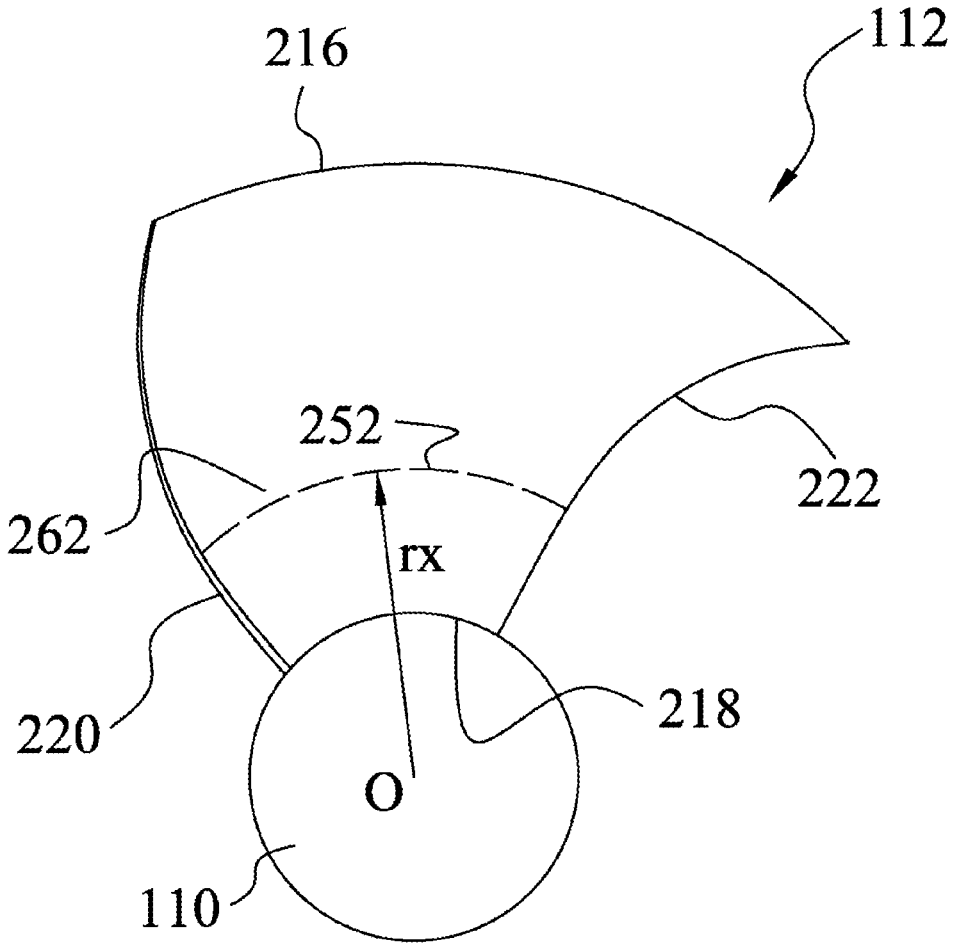
FIG. 6 shows a projection drawing, in an axial direction, of the blade according to an example of the present application.
Figure 7:
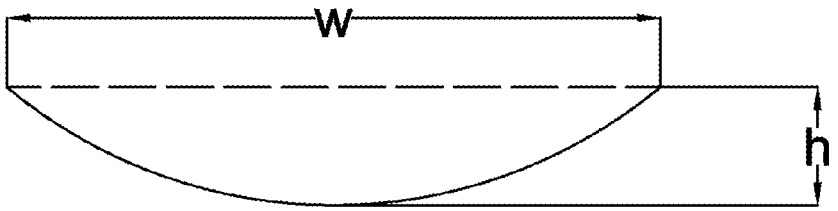
FIG. 7 shows a drawing of the relationship between arch width w and arch height h of the bent part of the blade in FIG. 6.

FIG. 5 shows a projection drawing, in an axial direction, of the blade used by the impeller in FIG. 1. FIG. 6 shows a projection drawing, in an axial direction, of the blade 112 according to an example of the present application. FIG. 7 shows a drawing of the relationship between arch width w and arch height h of the bent part 262 of the blade 112 in FIG. 6. The dotted line in FIG. 6 represents the position of the connecting line 252 of the lowest points in a radial direction of the bent part 262.

As shown in FIGS. 5-7, a curved line of the bent part 262 along a radial cross section of the blade 112 satisfies:

$$\text{arch width } w=a\times(\theta/1°)^m;$$

$$\text{arch height } h=b\times(\theta/1°)^n$$

wherein θ denotes a circumferential angle. Specifically, a point P is arbitrarily chosen on the blade tip 216, and an included angle formed between a connecting line from point P to the centre O of the hub 110 and a connecting line from an intersection point L of the blade tip 216 and the leading edge 222 to the center O of the hub 110 is the circumferential angle θ (see FIG. 5).

Here, $0.2\le a\le 2$; $0.05\le b\le 1$; $1\le m\le 3$; $1\le n\le 3$; and $0°\le\theta\le 180°$.

The arch width w represents the maximum width of the bent part 262 in a radial cross section; the arch height h represents the height of the highest point, relative to the lowest point, of the bent part 262 in a radial cross section.

As an example, m is equal to n, and the value range of w/h is $0.05\le w/h\le 0.4$.

As another example, when the blade 112 has an outer radius r1=340 mm, a=0.2, b=1, and m=n=1.

The radius of the lowest point in a radial direction of the bent part 262 satisfies:

$$rx=c\times(r1+r2)$$

wherein r1 is the outer radius of the blade 112;

r2 is the radius of the hub 110;

the value range of c is $0.1\le c\le 0.95$.

As shown in FIG. 6, the projection of the blade tip 216 of the blade 112 in the axial direction is a first arcuate projection (i.e. the radius of the first arcuate projection is r1); the projection of the blade base 218 of the blade 112 in the axial direction is a second arcuate projection (i.e. the radius of the second arcuate projection is r2); and the projection of the connecting line 252 of the lowest points in a radial direction of the bent part 262 in the axial direction is a third arcuate projection. The first arcuate projection, second arcuate projection and third arcuate projection are concentric; the circle centers thereof are all the projection point O of the axis of the hub 110 in the axial direction.

Figure 8:
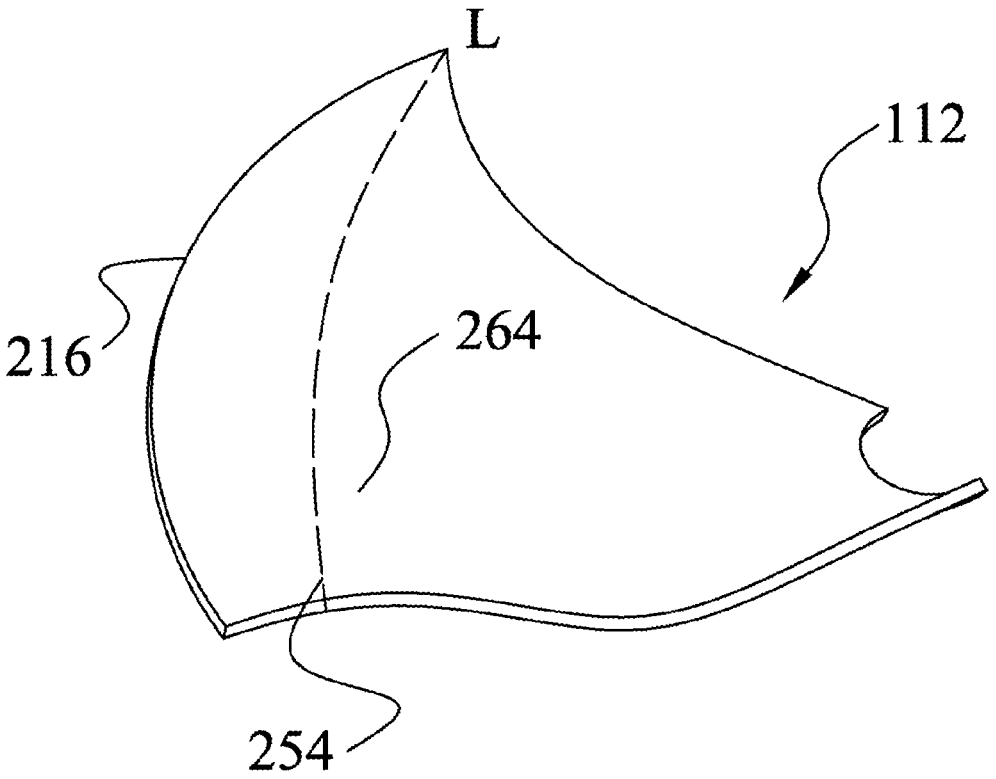
FIG. 8 shows a three-dimensional drawing of the blade in FIG. 6.
Figure 9:
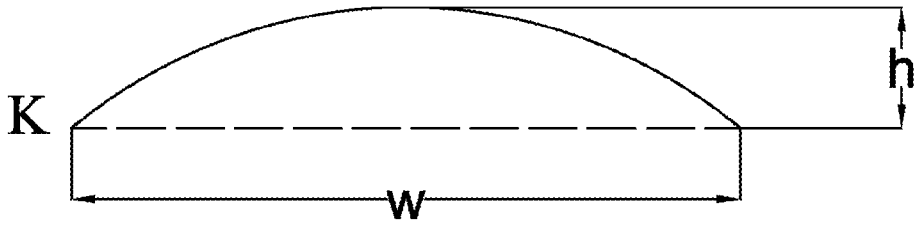
FIG. 9 shows a drawing of the relationship between arch width w and arch height h of the front arched part of the blade in FIG. 8.

FIG. 8 shows a three-dimensional drawing of the blade 112 in FIG. 6. FIG. 9 shows a drawing of the relationship between arch width w and arch height h of the front arched part 264 of the blade 112 in FIG. 8. The dotted line in FIG.

8 represents the position of the connecting line 254 of the highest points in a radial direction of the front arched part 264.

As shown in FIGS. 8-9, a curved line of the front arched part 264 in a radial cross section satisfies:

$$\text{arch width } w=a\times(\theta/1°)^m;$$

$$\text{arch height } h=b\times(\theta/1°)^n$$

wherein θ denotes a circumferential angle. Specifically, a point P is arbitrarily chosen on the blade tip 216, and an included angle formed between a connecting line from point P to the centre O of the hub 110 and a connecting line from an intersection point of the blade tip 216 and the leading edge 222 to the center O of the hub 110 is the circumferential angle θ (see FIG. 5).

The value range of a is $0.2\leq a\leq 2$; the value range of b is $0.05\leq b\leq 1$; the value range of m is $1\leq m\leq 3$; the value range of n is $1\leq n\leq 3$; and the value range of θ is $0°\leq\theta\leq 180°$.

The arch width w represents the maximum width of the front arched part 264 in a radial cross section of the blade 112; the arch height h represents the height of the highest point, relative to the lowest point, of the front arched part 264 in a radial cross section of the blade 112.

As an example, m is equal to n, and the value range of w/h is $0.05\leq w/h\leq 0.4$.

As another example, when the blade 112 has an outer radius r1=340 mm, a=0.2, b=1, and m=n=1.

Continuing to refer to FIG. 8, the projection of the connecting line 254 of the highest points in the axial direction gradually deviates from the blade tip 216 toward the blade base 218 in a direction from the leading edge 222 to the trailing edge 220. Specifically, an end point K of the front arched part 264 (as shown in FIG. 9) is any point on the blade tip 216. When the circumferential angle θ is 0°, the arch width w is equal to the arch height h which is equal to 0, at which time the arch width and arch height of the blade 112 are both 0, and the end point K coincides with the intersection point L of the blade tip 216 and the leading edge 222. When the end point K moves in a direction from the leading edge 222 to the trailing edge 220, the value of the circumferential angle θ increases, such that the values of the arch width w and arch height h also slowly increase. Thus, the highest points 254 in a radial direction of the front arched part 264 slowly move away from the blade tip 216 in a direction from the leading edge 222 to the trailing edge 220, thereby forming the connecting line 254 of the highest points of the front arched part 264, located at the front part 242 of the blade 112, substantially as shown by the dotted line in FIG. 8. The projection of the connecting line 254 of the highest points in the axial direction is an involute.

As another example, the ratio of the arch width w of the trailing edge 220 to the length of the trailing edge 220 is greater than or equal to 0.05 and less than or equal to 0.3.

Figure 10:
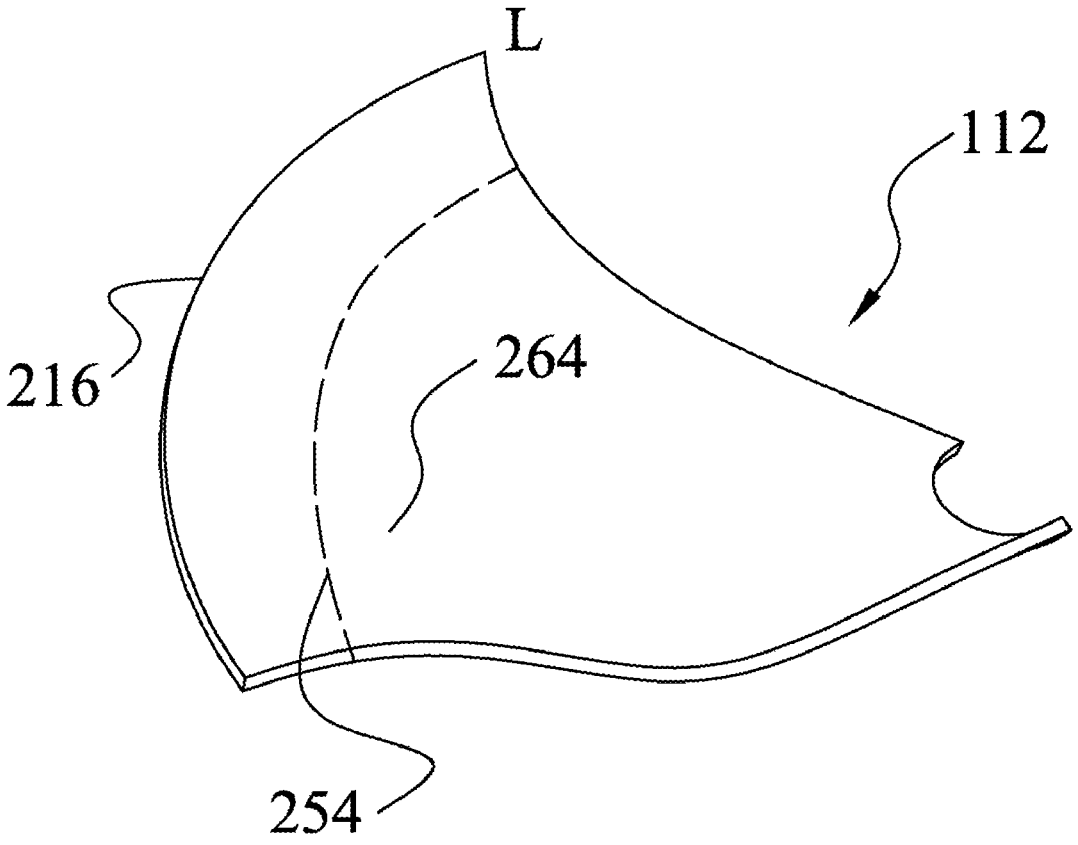
FIG. 10 shows a three-dimensional drawing of the blade according to another example of the present application.
Figure 11:
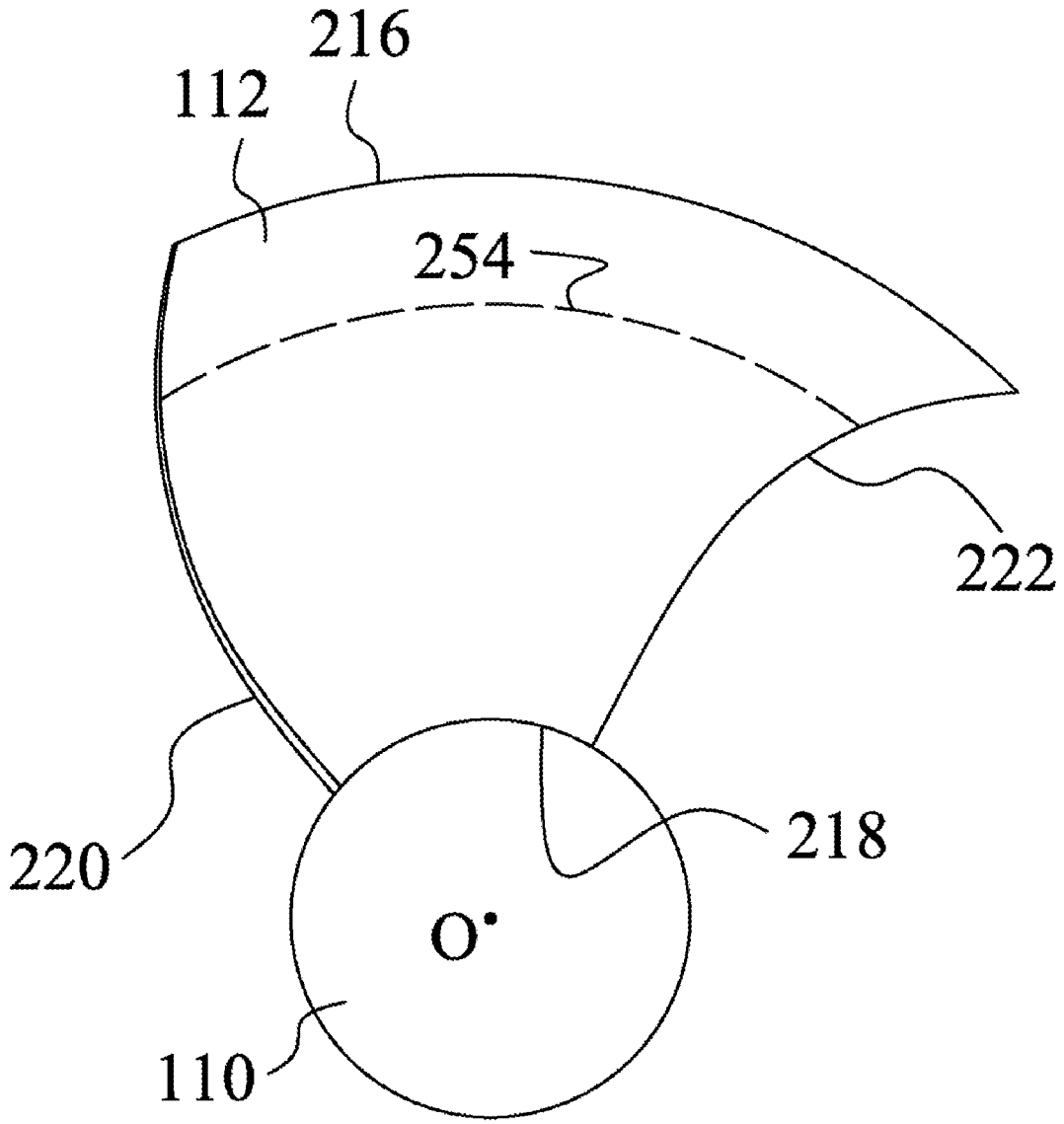
FIG. 11 shows a projection drawing, in the axial direction, of the blade in FIG. 10.

FIG. 10 shows a three-dimensional drawing of the blade 112 according to another example of the present application. FIG. 11 shows a projection drawing, in the axial direction, of the blade 112 in FIG. 10. The dotted lines in FIGS. 10-11 represent the position of the connecting line 254 of the highest points in a radial direction of the front arched part 264. As shown in FIGS. 10-11, the projection of the connecting line 254 of the highest points of the front arched part 264 in the axial direction is a fourth arcuate projection. The fourth arcuate projection is concentric with the first arcuate projection of the blade tip 216 and the second arcuate projection of the blade base 218; the circle centers thereof are all the projection point O of the axis of the hub 110 in the axial direction.

It must be explained that a blade profile cross section of the blade 112 from the leading edge to the trailing edge may be of various types; it may be a cross section of equal thickness or any two-dimensional airfoil profile. Although relations for the arch width w and arch height h are listed in the present application, the arched characteristics of the front arched part 264 and bent part 262 in the present application may also use arcs, parabolas, etc., which are likewise capable of achieving the objectives of improving blade performance and reducing noise in the present application.

Although only some characteristics of the present application are shown and described herein, those skilled in the art can make various improvements and modifications. Therefore, it should be understood that the attached claims are intended to cover all of the abovementioned improvements and modifications falling within the scope of the substantive spirit of the present application.

The invention claimed is:

1. A blade, comprising:

an upper surface and a lower surface, wherein the upper surface is a pressure face and the lower surface is a suction face;

a blade tip and a blade base;

a leading edge and a trailing edge, wherein the pressure face and the suction face each extend from the blade tip to the blade base and from the leading edge to the trailing edge; and a bent part, wherein the bent part is arched from the pressure face-toward the suction face, wherein the bent part has a lowest point in a radial cross section of the blade, wherein a connecting line of the lowest point extends from the leading edge to the trailing edge, and wherein a curved line of the bent part along the radial cross section of the blade defines an arch width w and an arch height h of the bent part, wherein a ratio of w/h is $0.05\leq w/h\leq 0.4$.

2. The blade of claim 1, wherein:

a projection of the blade tip in an axial direction is a first arcuate projection;

a projection of the blade base in the axial direction is a second arcuate projection;

a projection of the connecting line in the axial direction is a third arcuate projection; and wherein the first arcuate projection, the second arcuate projection, and the third arcuate projection are concentric.

3. The blade of claim 1, wherein the curved line of the bent part satisfies:

the arch width $w=a\times(\theta/1°)^m$, wherein a value range of a is $0.2\leq a\leq 2$, a value range of m is $1\leq m\leq 3$, θ is a circumferential angle relative to a rotational axis of the blade, and a value range of θ is $0°\leq\theta\leq 180°$; and the arch height $h=b\times(\theta/1°)^n$, wherein a value range of b is $0.05\leq b\leq 1$, a value range of n is $1\leq n\leq 3$, m is equal to n, and the ratio of w/h is $0.05\leq w/h\leq 0.4$.

4. A blade, comprising:

an upper surface and a lower surface, wherein the upper surface is a pressure face and the lower surface is a suction face;

a blade tip and a blade base;

a leading edge and a trailing edge, wherein the pressure face and the suction face each extend from the blade tip to the blade base and from the leading edge to the trailing edge;

a front part and a rear part, wherein the front part is close to the blade tip and the rear part is close to the blade base; and a front arched part located at the front part, wherein the front arched part is arched from the suction face toward the pressure face, wherein the front arched part has a highest point in a radial cross section of the blade, wherein a connecting line of the highest point extends from the leading edge to the trailing edge, wherein a curved line of the front arched part along the radial cross section of the blade defines an arch width w and an arch height h of the front arched part, and wherein a ratio of the arch width w at the trailing edge to a length of the trailing edge is greater than or equal to 0.05 and less than or equal to 0.3.

5. The blade of claim 4, wherein:

a projection of the blade tip in an axial direction is a first arcuate projection;

a projection of the blade base in the axial direction is a second arcuate projection;

a projection of the connecting line in the axial direction is a third arcuate projection; and wherein the first arcuate projection, the second arcuate projection, and the third arcuate projection are concentric.

6. The blade of claim 4, wherein a projection of the connecting line in an axial direction deviates from the blade tip toward the blade base in a direction from the leading edge to the trailing edge.

7. The blade of claim 6, wherein the projection of the connecting line in the axial direction is an involute.

8. The blade of claim 4, wherein the curved line of the front arched part satisfies:

the arch width $w=a\times(\theta/1°)^m$, wherein a value range of a is $0.2\leq a\leq 2$, a value range of m is $1\leq m\leq 3$, θ is a circumferential angle relative to a rotational axis of the blade, and a value range of θ is $0°\leq\theta\leq 180°$; and the arch height $h=b\times(\theta/1°)^n$, wherein a value range of b is $0.05\leq b\leq 1$, a value range of n is $1\leq n\leq 3$, wherein m is equal to n, and wherein a value range of w/h is $0.05\leq w/h\leq 0.4$.

9. The blade of claim 4, comprising a bent part, wherein the bent part is arched from the pressure face toward the suction face, wherein the bent part has a lowest point in the radial cross section of the blade, wherein an additional connecting line of the lowest point extends from the leading edge to the trailing edge, and wherein the additional connecting line is located at the rear part.

10. An axial flow impeller, comprising:

a hub having a central axis, wherein the hub is configured to rotate about the central axis, and wherein a cross section of the hub in an axial direction is circular; and at least two blades extending from an outer circumferential face of the hub, wherein each blade of the at least two blades comprises:

an upper surface and a lower surface, wherein the upper surface is a pressure face and the lower surface is a suction face;

a blade tip and a blade base;

a leading edge and a trailing edge, wherein the pressure face and the suction face each extend from the blade tip to the blade base and from the leading edge to the trailing edge;

a bent part, wherein the bent part is arched from the pressure face toward the suction face, wherein the bent part has a lowest point in a radial cross section of a corresponding blade, wherein a connecting line of the lowest point extends from the leading edge to the trailing edge, wherein a projection of the blade tip is a first arcuate projection, a projection of the blade base is a second arcuate projection, a projection of the connecting line is a third arcuate projection, and wherein the first arcuate projection, the second arcuate project, and the third arcuate projection are concentric; and a front part and a rear part, wherein the front part is close to the blade tip and the rear part is close to the blade base, a front arched part located at the front part, wherein the front arched part is arched from the suction face toward the pressure face, wherein the front arched part has a highest point in the radial cross section of the corresponding blade, and wherein an additional connecting line of the highest point extends from the leading edge to the trailing edge.

11. The axial flow impeller of claim 10, wherein a curved line of the bent part along the radial cross section of the corresponding blade defines an arch width w and an arch height h of the bent part, wherein the curved line of the bent part satisfies:

the arch width $w=a\times(\theta/1°)^m$, wherein a value range of a is $0.2\leq a\leq 2$, a value range of m is $1\leq m\leq 3$, θ is a circumferential angle relative to the central axis, and a value range of θ is $0°\leq\theta\leq 180°$; and the arch height $h=b\times(\theta/1°)^n$, wherein a value range of b is $0.05\leq b\leq 1$, a value range of n is $1\leq n\leq 3$, m is equal to n, and the ratio of w/h is $0.05\leq w/h\leq 0.4$.

* * * * *